US005840010A

United States Patent [19]

Kobayashi et al.

[11] Patent Number: 5,840,010

[45] Date of Patent: Nov. 24, 1998

[54] INCUBATOR

[75] Inventors: Shinichi Kobayashi; Eiji Koike; Kazunori Miyagawa; Kazuo Matubara, all of Tokyo, Japan

[73] Assignee: Atom Medical Corporation, Tokyo, Japan

[21] Appl. No.: 835,658

[22] Filed: Apr. 9, 1997

[30] Foreign Application Priority Data

Apr. 12, 1996 [JP] Japan ..... 8-115618

[51] Int. Cl.[6] ..... A61G 11/00

[52] U.S. Cl. ..... 600/22

[58] Field of Search ..... 600/21, 22

[56] References Cited

U.S. PATENT DOCUMENTS

| | | | |
|---|---|---|---|
| 4,361,137 | 11/1982 | Grosholz | 600/22 |
| 4,936,824 | 6/1990 | Koch et al. | 600/22 |
| 5,387,177 | 2/1995 | Dunn | 600/22 |

FOREIGN PATENT DOCUMENTS

| | | |
|---|---|---|
| 2-9789 | 3/1990 | Japan . |
| 2-38736 | 10/1990 | Japan . |
| 4-221558 | 8/1992 | Japan . |
| 7-507216 | 8/1995 | Japan . |
| 7-108310 | 11/1995 | Japan . |
| 7-328077 | 12/1995 | Japan . |
| 8-679 | 1/1996 | Japan . |

*Primary Examiner*—John P. Lacyk
*Assistant Examiner*—Samuel Gilbert
*Attorney, Agent, or Firm*—Woodcock Washburn Kurtz Mackiewicz & Norris LLP

[57] ABSTRACT

Since a rest table for a baby's body can be moved between the inside and outside of a hood through the opening portion of the hood, a treatment for the baby's body can be performed after the rest table is pulled out midway to the outside of the hood. Since an air stream flowing downward along the opening portion from its upper portion can be injected, even while the rest table is pulled out midway to the outside of the hood, formation of an air curtain is not interfered with, and the air stream is supplied to the baby's body on the rest table as well. In spite that the treatment for the baby's body can be performed easily, changes in an atmosphere in the hood and in an atmosphere for the baby's body under treatment are small to decrease an adverse influence on the baby's body.

2 Claims, 2 Drawing Sheets

INCUBATOR

BACKGROUND OF THE INVENTION

1. Field of the Invention

The present invention relates to an incubator for housing a newborn baby or a premature baby in a hood and incubating the baby.

2. Description of the Prior Art

FIG. 1 shows a conventional incubator 11. This incubator 11 has a transparent hood 12 of a shape close to a rectangular parallelepiped. A plurality of hand windows 13 are formed in the side surfaces of the hood 12. The hand windows 13 have diaphragm mechanisms or the like that are opened when a baby's body (not shown) is treated by inserting the hands into the hood 12 therethrough.

An opening portion 14 is formed in one side surface of the hood 12. A transparent door 16 which pivots about hinges 15 as the center is attached to the opening portion 14. More specifically, if a sufficient treatment cannot be performed for the baby's body by only inserting the hands into the hood 12 through the hand windows 13, the door 16 is opened, and the treatment for the baby's body in the hood 12 is performed through the opening portion 14.

An atmosphere having an air temperature, humidity, and the like that are controlled to be optimum for the baby's body is set in the hood 12. An air curtain as an air stream flowing upward along the opening portion 14 from its lower portion is formed so that, even if the door 16 is opened and the treatment for the baby's body in the hood 12 is performed through the opening portion 14 in the manner as described above, a change in atmosphere in the hood 12 is reduced and an adverse influence on the baby's body is decreased.

Sometimes, however, even if the door 16 is opened, the hood 12 and the like serve as obstacles and a sufficient treatment cannot be performed for the baby's body in the hood 12. For this reason, a rest table (not shown) on which the baby's body is laid may be made movable between the inside and outside of the hood 12 through the opening portion 14 whose door 16 is open.

When a treatment for the baby's body is performed after the rest table is completely pulled out to the outside of the hood 12, the baby's body is completely exposed to the external atmosphere different from the atmosphere in the hood 12, the air temperature, humidity, and the like of which are controlled, and the baby's body is adversely affected by it.

When a treatment for the baby's body is performed after the rest table is pulled out midway to the outside of the hood 12, formation of the air curtain as the air stream flowing upward along the opening portion 14 from its lower portion is interfered with by the rest table, and the atmosphere in the hood 12 is disturbed. As a result, until the atmosphere in the hood 12 is restored to the initial state, the baby's body returned into the hood 12 is adversely affected.

OBJECT AND SUMMARY OF THE INVENTION

It is, therefore, an object of the present invention to provide an incubator in which in spite that a treatment for the baby's body can be performed easily, changes in an atmosphere in a hood and in an atmosphere for the baby's body under treatment are small to decrease an adverse influence on the baby's body.

An incubator according to the present invention is characterized by comprising a hood having a side surface formed with an opening portion and a door attached to the opening portion, a baby's body rest table which is movable between an inside and an outside of the hood through the opening portion whose door is open, and air curtain forming means for injecting an air stream flowing downward along the opening portion from its upper portion.

In this manner, since the rest table for the baby's body can be moved between the inside and outside of the hood through the opening portion of the hood, a treatment for the baby's body can be performed after the rest table is pulled out midway to the outside of the hood. In spite of this, an air curtain forming means injects an air stream that flows downward along the opening portion of the hood from its upper portion. Even while the rest table is pulled out midway to the outside of the hood, formation of the air curtain is not interfered with, and the air stream is supplied to the baby's body on the rest table as well. Although the treatment for the baby's body can be performed easily, changes in an atmosphere in the hood and in an atmosphere for the baby's body under treatment are small to decrease an adverse influence on the baby's body.

In the incubator according to the present invention, the hood and the door are preferably formed with channels for the air stream, and while the door is closed, the channels form a circulation path for the air stream. With this arrangement, while the door is closed, the circulation path for the air stream flowing along the hood and the door is formed. Therefore, even while the door is closed, the air stream for forming the air curtain can be circulated along the hood and the door. As a result, the interior of the hood can always be controlled to have a desired atmosphere.

BRIEF DESCRIPTION OF THE DRAWINGS

FIGS. 2A and 2B are side sectional views of an embodiment of the present invention, in which FIG. 2A shows a state wherein the door is kept closed, and FIG. 2B shows a state wherein the door is open.

DETAILED DESCRIPTION OF THE PREFERRED EMBODIMENT

Figure 1:
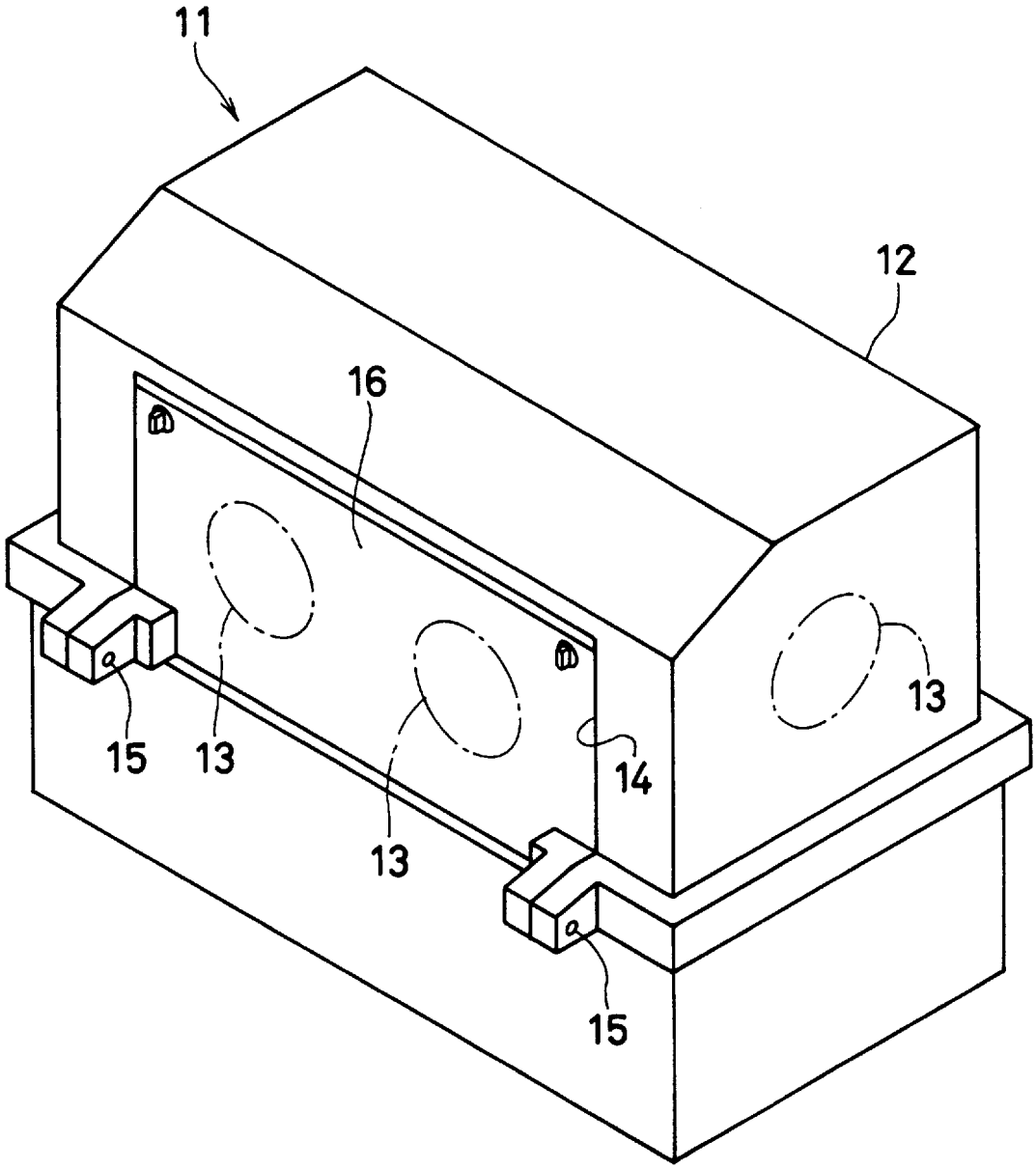
FIG. 1 PRIOR ART
FIG. 1 is a perspective view of a conventional incubator concerning the present invention.

An embodiment of the present invention will be described below with reference to FIGS. 2A and 2B. An incubator 21 of this embodiment also has a transparent hood 22 whose outer wall 22*a* has a shape close to a rectangular parallelepiped. An opening portion 23 is formed in one side surface of the hood 22, and a door 25 which pivots about hinges 24 as the center is attached to the opening portion 23.

Transparent inner walls 22*b* are formed on a wall surface, of the hood 22, other than those on the sides of the head and feet of the housed baby's body, to oppose the outer wall 22*a* and to be separated from the outer wall 22*a* by a predetermined distance. A transparent outer wall 25*a* and a transparent inner wall 25*b* are formed on the door 25 as well. At a position away downward by a predetermined distance from a bottom surface 26 in the incubator 21 covered with the hood 22, another bottom surface 27 is formed.

Except for the surfaces on the head and feet sides of the housed baby's body, the wall surfaces form a double structure on any of the four surfaces, and spaces in the double-structure wall surfaces communicate with each other. A controller 31 for controlling the air temperature, humidity, and the like to desired values, and a blower 33 for blowing a controlled air in the direction of an arrow 32 are arranged between the bottom surfaces 26 and 27.

A rest table 34 for the baby's body is formed on the bottom surface 26 in the incubator 21 covered with the hood 22. As shown in FIGS. 2A and 2B, this rest table 34 is movable between the inside and outside of the hood 22 through the opening portion 23 whose door 25 is open. Although not shown, also in this embodiment, hand windows are formed to extend through the outer and inner walls 22*a* and 22*b* of the hood 22 and the outer and inner walls 25*a* and 25*b* the door 25.

Figure 2A:
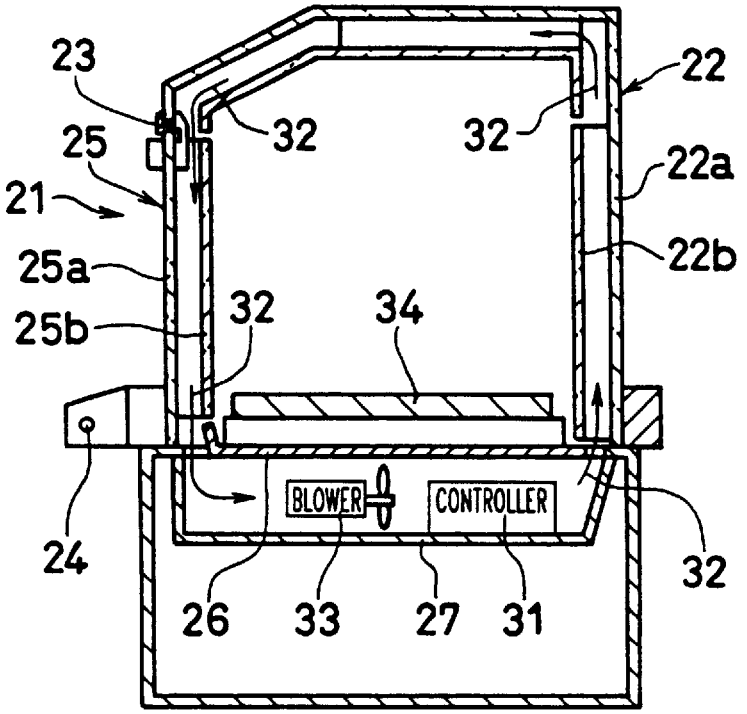

In the above embodiment, as is apparent from FIG. 2A, while the door 25 is closed, air with a temperature, humidity, and the like which are controlled to desired values circulates between the wall surfaces having the double structure on the four surfaces other than the surfaces of the head and feet sides of the housed baby's body. By this circulation, the temperature, humidity, and the like of the air in a space where the baby's body is housed are also controlled to desired values.

Figure 2B:
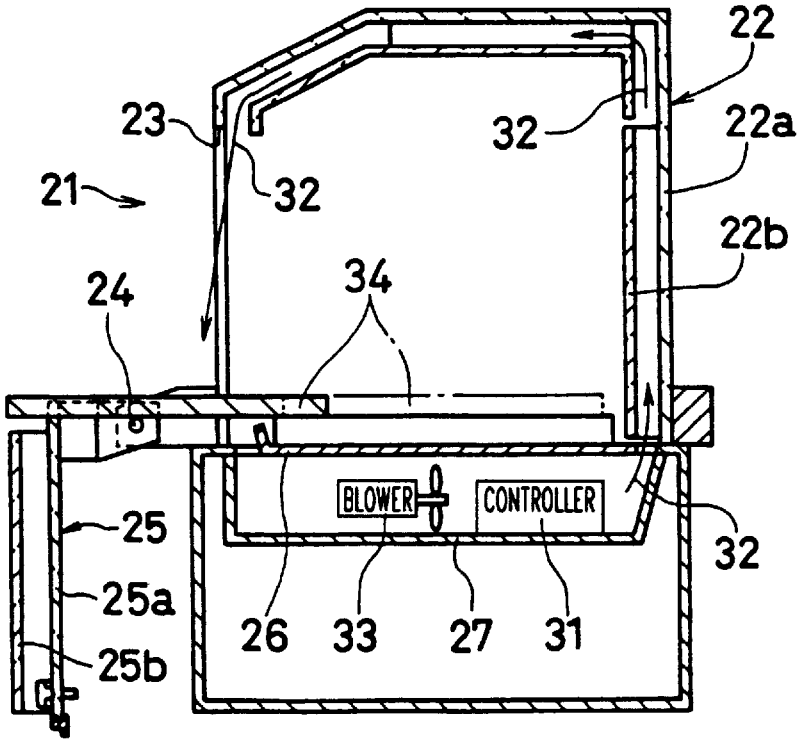

As is apparent from FIG. 2B, while the door 25 is open and the rest table 34 is pulled out midway to the outside of the hood 22 in order to allow a treatment for the baby's body laid on the rest table 34 and housed in the incubator 21, the air circulation path is blocked by the rest table 34 in the lower portion of the opening portion 23, and the air does not circulate.

However, the air stream flowing downward along the opening portion 23 from its upper portion is kept injected to form the air curtain, and the air stream is also supplied to the body on the rest table 34. Therefore, changes in an atmosphere in the hood and in an atmosphere for the baby's body under treatment are small to decrease an adverse influence on the baby's body.

What is claimed is:

1. An incubator comprising:

a hood having a side surface formed with an opening portion and a door attached to said opening portion;

a rest table coupled to said incubator and which is movable between an inside and an outside of said hood through said opening portion when said door is open; and air curtain forming means for injecting an air stream flowing downward along said opening portion from an upper portion of said opening portion.

2. An incubator according to claim 1, wherein said hood and said door are formed with channels for the air stream, and while said door is closed, said channels form a circulation path of the air stream.

* * * * *